United States Patent [19]

Brucken

[11] 4,137,018

[45] Jan. 30, 1979

[54] ROTARY VANE VARIABLE CAPACITY COMPRESSOR

[75] Inventor: Byron L. Brucken, Miamisburg, Ohio

[73] Assignee: General Motors Corporation, Detroit, Mich.

[21] Appl. No.: 849,032

[22] Filed: Nov. 7, 1977

[51] Int. Cl.[2] ..... F04B 41/00; F04B 49/02; F01C 21/14; F04C 17/00

[52] U.S. Cl. ..... 417/440; 418/47; 418/78; 418/238

[58] Field of Search ..... 418/16, 30, 75, 78, 418/236, 238; 417/310, 440

[56] References Cited

U.S. PATENT DOCUMENTS

| | | | |
|---|---|---|---|
| 2,899,903 | 8/1959 | Ryder | 417/440 |
| 3,120,814 | 2/1964 | Mueller | 417/310 |
| 3,451,614 | 6/1969 | Tosh | 417/440 |
| 3,515,496 | 6/1970 | Eddy | 417/440 |
| 3,565,558 | 2/1971 | Tobacman | 418/236 |
| 3,799,707 | 3/1974 | Newton | 418/78 |
| 4,060,343 | 11/1977 | Newton | 418/78 |

FOREIGN PATENT DOCUMENTS

| | | | |
|---|---|---|---|
| 1035238 | 4/1953 | France | 418/16 |
| 1038729 | 5/1953 | France | 418/16 |
| 1048005 | 7/1953 | France | 418/236 |

*Primary Examiner*—John J. Vrablik
*Attorney, Agent, or Firm*—Edward P. Barthel

[57] ABSTRACT

A reciprocating vane rotary compressor for an automotive air conditioning system wherein the compressor capacity may be varied in response to the evaporator pressure or temperature such that the evaporator pumps only the amount of refrigerant required at moderate ambient temperatures. The compressor has a circumferentially adjustable modulation ring mounted in concentric relation with the internal compressor chamber surface. The ring, having by-pass port means, may be advanced in the direction of rotation of the rotor, with the port means operative to delay the time that the chamber goes under compression. By varying the induction cut-off point of the ring by-pass port means, the compressor chamber undergoing pre-compression returns gas via a suction transfer passage in the housing to the compressor suction cavity. The compressor rotor is mounted on a unique overhanging stub shaft arrangement to provide a simplified single journal bearing location for the rotor.

1 Claim, 11 Drawing Figures

ROTARY VANE VARIABLE CAPACITY COMPRESSOR

This invention relates to a variable capacity rotary compressor and more particularly to a free vane rotary refrigerant compressor for use with an automotive air conditioning system.

With variable compressors adapted for use in automotive air conditioning systems of an automotive vehicle, it is desired that the compressor capacity may be varied in response to the evaporator pressure or temperature so that the compressor pumps only the amount of refrigerant required at moderate ambient temperatures. There has been an increased need in automotive air conditioning systems for an improved lightweight compressor which is adapted to be driven by the car engine and in which the output of the compressor is modulated in response to refrigeration requirements, thereby contributing to reduced weight and improved fuel consumption for the automobile.

It is an object of the present invention to provide an improved air conditioning rotary refrigerant compressor with free reciprocating vanes having a circumferentially adjustable modulation ring with port means therein operative, when the ring is angularly advanced in the direction of rotation of the rotor, to delay the time the refrigerant gas in the rotor chamber goes under compression thereby reducing the capacity of the compressor.

Another object of this invention is the provision of an improved compact variable capacity rotary compressor wherein the displacement is controlled by allowing the compression chamber to be filled with suction gas during each cycle; and wherein control means provide for rotating a capacity adjustment plate, concentrically mounted in a counterbored recess of the compression chamber, with the plate having port means in the form of a notched-out peripheral edge portion operative to unload a portion of the suction gas; whereby suction gas which has entered the chamber is by-passed into transfer passage means for return to the compressor suction cavity before the pressurizing thereof enabling the compressor to pump at variable capacities.

It is still another object of the present invention to provide an improved variable capacity compressor having the objects recited above together with the compressor rotor mounted on an overhung stub shaft whereby only a single journal bearing location is required.

Further objects and advantages of the present invention will be apparent from the following description, reference being had to the accompanying drawings, wherein a preferred embodiment of the present invention is clearly shown.

Figure 1:
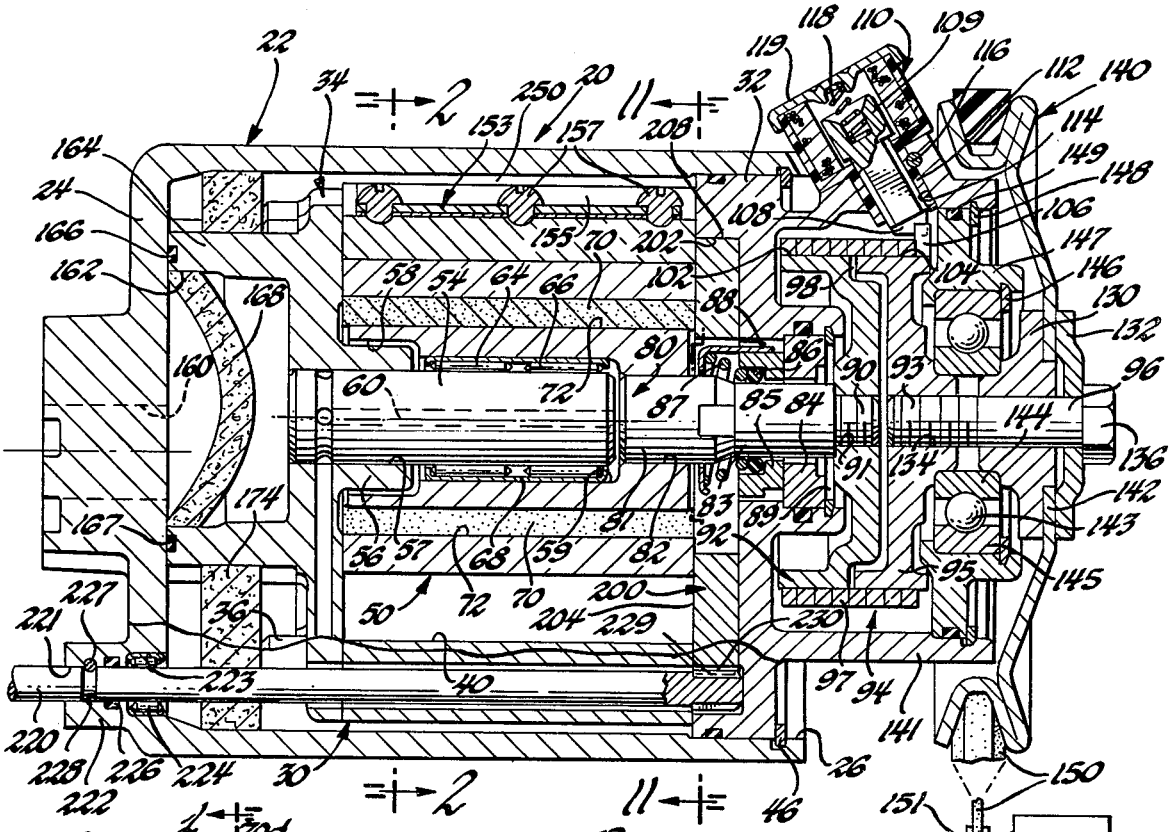
FIG. 1 is a sectional view through the refrigerator compressor taken substantially along the line 1—1 of FIG. 2.

Referring now to the drawings and more particularly to FIG. 1, there is shown a compressor 20, including a sealed cast aluminum casing or shell 22 of cylindrical cross section closed at its rear end by an integral wall 24 and open at its front end 26 to receive the mechanical components of the compressor assembly. The shell front open end 26 receives a bored cylinder 30 having front 32 and rear 34 heads or cover sections secured to the cylinder by through bolts 36 to define a cylindrical pumping or working chamber 40. The entire assembly is telescoped within the shell with the front cylinder head 32 in sealed relation with its open end 26 by suitable means as a snap ring 46.

Figure 2:
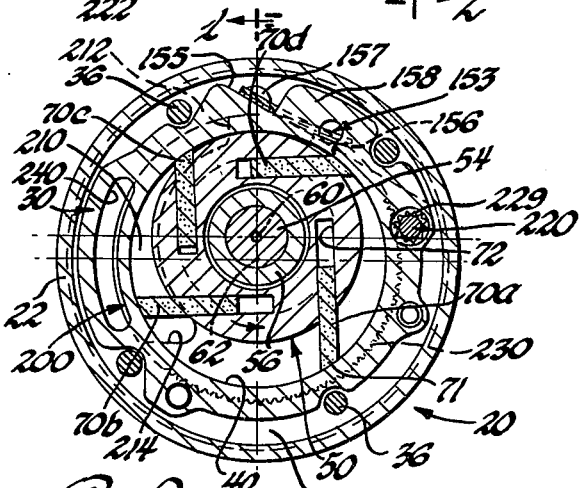
FIG. 2 is a sectional view taken substantially along the line 2—2 of FIG. 1 showing maximum capacity operation.

The cylinder chamber 40 is of substantially greater diameter than cylindrical pumping rotor tube 50 which is axially offset therefrom. A rear rotor stub or overhung shaft 54 is retained in press fit cantilevered fashion within rear head hub 56 central bore 57. The rear head integral hub 56 extends into aligned rotor stepped bore outer counter sunk portion 58 while the stub shaft 54 telescope into stepped bore intermediate portion 59. The stub shaft 54 is located on an axis 60 eccentric to the axis 62 (FIG. 2) of the working chamber 40. Thus, rotor tube 50 is rotatably supported on the stub shaft 54 by suitable journal bearing means such as a double set of antifriction needle bearings 64 and 66 in bearing cage 68 for rotation about eccentric axis 60 within the chamber 40. As best seen in FIG. 2, the rotor tube 50 has a plurality of vanes 70 therein shown formed of carbon material with radiused outer edges 71 located in non-radial slots. In the preferred form the rotor is provided with a series of four non-radial slots 72 arranged circumferentially and each extending along a plane parallel to the rotor's axis 60. The slots 72 are slanted to incline the vanes 70 rearwardly away from the direction of rotation of the rotor tube 50 with the vanes being slidably mounted in their associated slots. A front rotor driven shaft, indicated generally at 80 in FIG. 1, is aligned on axis 60 in a coaxial manner with the rear stub shaft 54 such that the shaft 80 has its inner maximum diameter portion 81 secured in press-fit relation in rotor reduced bore portion 82. Intermediate portion 83 of the driven shaft 80 may be sealed by a sealing ring 84 in cooperation with an abutting sleeve 85 that carries an O-ring 86. The sleeve 85 is urged against the sealing ring 84 by a coil spring 87 that backs against a spring seat cup 88 fixed on sleeve 85 while the seal ring 84 backs against a snap ring 89.

In the disclosed embodiment the driven shaft 80 has a forward reduced end 90 threaded for fastened retention in tapped bore 91 of driven drum 92 portion of clutch means which is preferably in the form of a solenoid actuated spring clutch, generally indicated at 94. The clutch 94 has a driver drum 95 secured on the threaded portion 93 of front drive bolt 96. A clutch spring 97 is dimensioned to extend across gap 98 between the drums and surround clutching faces 102 and 104 of the clutch drums 92 and 95, respectively. The end portion of spring 97 is deformed to provide a radially extending tang 106 positioned to be engaged by stop portion 108 of armature 109 of a solenoid assembly shown generally at 110. The solenoid assembly 110 is suitably secured to front head 32 by means of solenoid stem 112 extending into housing canted bore 114 and retained therein such as by a set screw 116. The armature stop 108 is biased inwardly by coil compression spring 118 retained by cap 119 to engage tang 106 causing the spring 97 to release its grip on at least clutch face 102 and stop transmission of rotation to the output drum 92. Upon solenoid coil 120 being energized by electrical leads connected to a suitable electrical power source (not shown) the armature 109 is retracted outwardly to clear tang 106 from armature stop 108 and cause clutch spring 97 to tightly grip clutching surfaces 102 and 104 and thereby transmits rotation from input drum 95 to output drum 92.

A flange disc 130 and pressure plate 132 are mounted on drive bolt 96. The driving drum 95 is provided with a tapped bore 134 for receipt of the drive bolt 96. As a consequence, tightening of bolt head 136 will urge the associated disc 130 and pressure plate 132 axially together with the result that pulley 140 has its web portion 142 lightly clamped therebetween. An antifriction pulley bearing 143, upon which the pulley 140 is freely rotatable, is interposed on its inner ring 144 between the driving drum 95 and disc 130. The bearing outer ring 145 is fixed by snap ring 146 to front head pulley bearing support collar 147. The support collar 147 is in turn retained by snap ring 148 and sealed by O-ring 149, to the inner surface of front head tubular extension 141. Thus, the pulley 140 is electromagnetically clutchable and declutchable to drum 72 to drive the shaft 80 and rotate the compressor rotor 60. Since the illustrative embodiment is particularly designed for automotive use, a V-belt pulley groove of pulley 140 contains a V-belt 150 providing a clutched driving connection with a pulley 151 on the crankshaft of an automobile engine 152.

Figure 8:
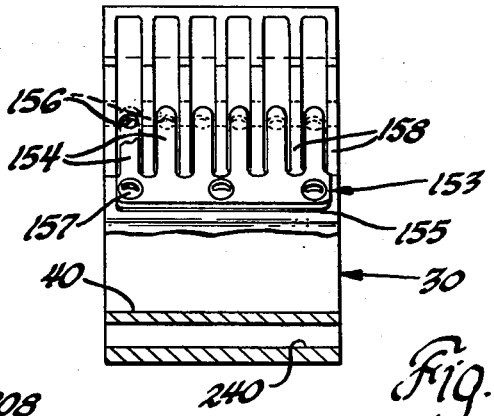
FIG. 8 is an elevational view, partly in section, of the discharge reed valve.

As seen in FIGS. 2 and 8, the compressor assembly includes a curved multi-fingered stop 153 for a multi-fingered reed valve 154 secured to tangential surface 155 of the cylinder 30 on the outside of a plurality of discharge ports 156 by bolts 157. The fingers of the valve stop and reed valve are separated from one another by a plurality of spacers shown at 158. It will be noted that the cylinder 30 does not occupy the internal cross section of the shell 22 thereby providing an air flow space therebetween.

Figure 5:
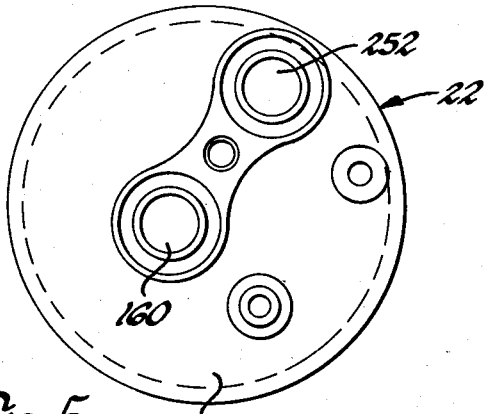
FIG. 5 is an end elevational view of the compressor.
Figure 6:
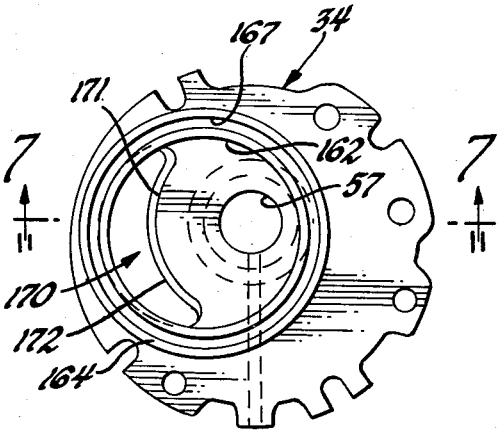
FIG. 6 is an elevational view of the rear end plate.
Figure 7:
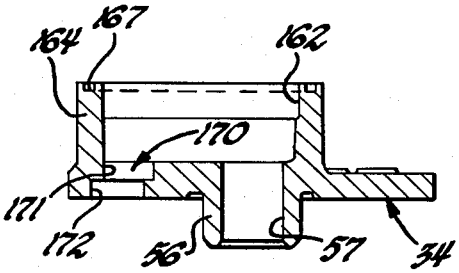
FIG. 7 is an enlarged sectional view taken on line 7—7 of FIG. 6.

As seen in FIGS. 5, 6 and 7, suction inlet port 160 in rear wall 24 communicates with suction enclosure 162 formed in the rear cover or head 34 by means of offset circular housing 164 having its rearward edge sealed to the inner shell wall 24 by O-ring seal 166 received in annular groove 167. A filter screen 168 (FIG. 1) is located between the housing inlet port 160 and rear head suction intake aperture means 170 comprising outer crescent-shaped portions 171 and an inner offset extended portion 172. An oil separator 174, of suitable permeable material such as coarse mesh fibers, encircles the housing 164 with its outer circular edge conforming to the internal diameter of shell 22.

Figure 9:
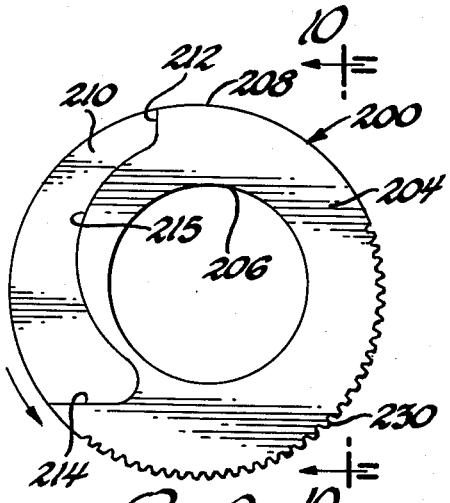
FIG. 9 is an elevational detailed view of the adjustment plate.
Figure 10:
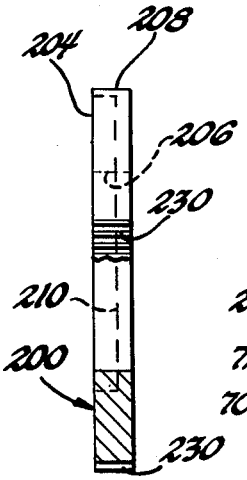
FIG. 10 is an elevational view, partly in section, taken on line 10—10 of FIG. 9.

As best seen in FIGS. 1, 9 and 10, modulator means in the form of a modulator ring or plate, generally indicated at 200, is fitted in front head counterbore 202 concentric with chamber 40 so as to be rotationally or circumferentially adjustable therein. The plate inner face 204 defines an annular surface between the inner and outer circular edges 206 and 208 on which an arcuate scarf or notched-out cavity 210 is provided extending between a first short trailing tangential edge 212 and a second longer leading tangential cut-off edge 214 interconnected by arcuate portion 215.

Figure 3:
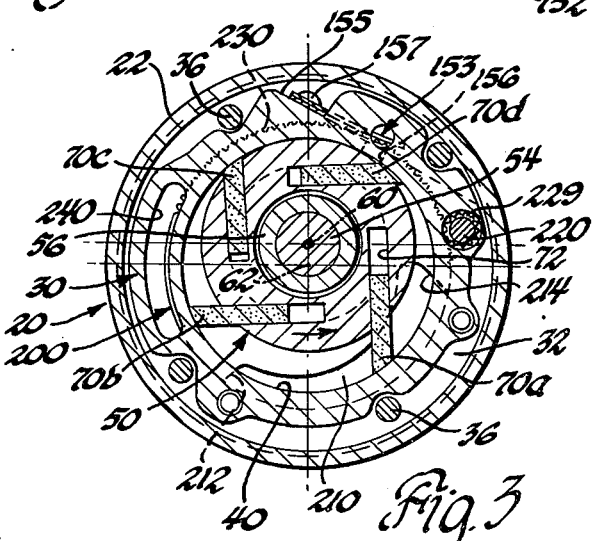
FIG. 3 is a sectional view taken substantially along the line 2—2 of FIG. 1 showing minimum capacity operation.
Figure 4:
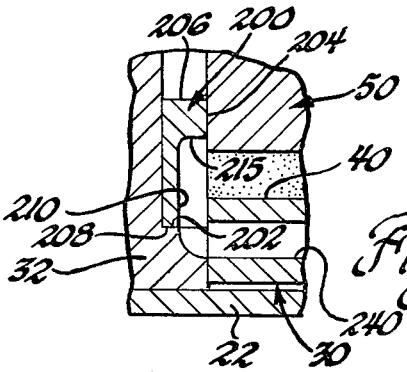
FIG. 4 is a fragmentary enlarged sectional view taken substantially along the line 4—4 of FIG. 11.

In FIGS. 2 and 3 it can be seen that the angular orientation of the plate 200 is determined by adjustment or control means in the form of a control shaft member 220 which extends through a bore 221 in the rear head wall boss portion 222. The bore 221 has a counterbore 223 in wall 24 receiving journal needle bearings 224 and is sealed by O-rings 226 and retained by pin 227 in annular groove 228 allowing free rotation of shaft 220. Pinion gears or teeth 229 are formed on shaft forward or inner end and are arranged to mesh with complementary gear teeth 230 on the plate peripheral outer edge 208 defining an arcuate rack of about 90° extent such that rotation of the shaft 220 results in adjustable rotation of the plate 200. The shaft 220 may be rotated manually by means of a suitable tool or automatically as by an appropriate hydraulic servomotor means as discussed, for example, in U.S. Pat. application Ser. No. 728,545 entitled Variable Capacity Radial-4 Compressor to D. A. Black and assigned to the assignee of the instant application. As explained in the Black patent application, the servomotor could be made responsive to suitable control indicia such as pressure signals from the evaporator to a hydraulic control valve. In this way a control or logic module could regulate the energy consumption of an automotive air conditioning system by varying the output capacity of the compressor 20 to match the cooling requirements of the car in a manner to be explained.

The compressor 20 is designed to operate when rotator 50 revolves in a counterclockwise direction as viewed in FIGS. 2 and 3. Under operating conditions the rearwardly inclined or "trailing" vanes 70*a*, 70*b*, 70*c* and 70*d* will be forced outwardly to their position shown to firmly bear against cylinder wall 40 and establish a fluid-tight, sealed connection thereto. The vane tip portions 71 are maintained in engagement with the wall 40 by virtue of high pressure gas flowing into the slots 72 and urging the vanes radially outwardly.

It will be noted in FIGS. 2, 3 and 8 that the cylinder 30 includes suction gas crossover passage means in the form of an integral axially extending passage 240 having its open ends located in each end face of the cylinder. The crossover passage 240 is formed with an arcuate section extending through an included angle of about 60° so as to maintain communication with plate notch 210 throughout its angular adjustment travel for a reason explained below.

Figure 11:
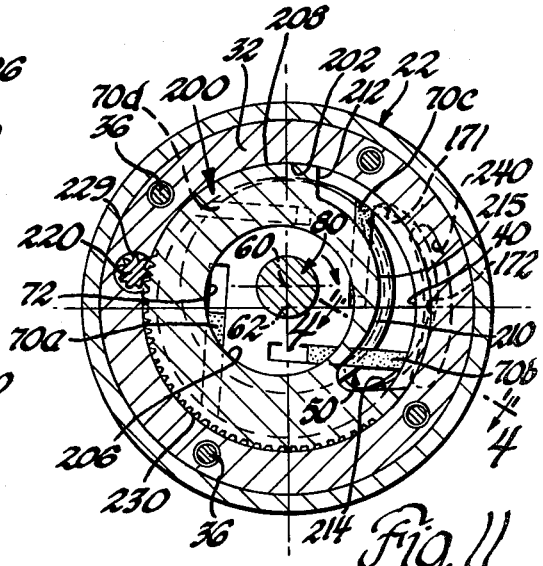
FIG. 11 is a sectional view taken on line 11—11 of FIG. 1.

In the compressor's maximum capacity mode of operation, shown in FI. 2, suction gas from the evaporator of the automotive air conditioning system is admitted to inlet 160. The suction gas flows into the rear head suction chamber 162 and thence into a moving compartment on the suction side of the compression chamber 40, as for example the moving compartment between vanes 70*b* and 70*c*, through the outer and inner overlying crescent-shaped apertures 171 and 172 comprising rear head suction gas intake 170. It will be noted in FIG. 11 that the inner crescent-shaped aperture 172 extends outwardly a radial distance beyond outer aperture 171 so as to communicate with the cylinder suction gas crossover passage 240. In this manner the rear suction gas intake orifice 170 feeds suction gas during maximum capacity operation of the compressor. As seen in FIG.

4, the front modulator plate notch 210 provides a front suction gas intake cavity, by virtue of the modulator plate 200 having its inner face 204 in flush slidable contact with the front end face of the rotor 30. As seen in FIG. 9 the arcuate extent of the modulator plate notch 210 is of the order of 110° and consequently is always open to the transfer passage 240 throughout the angular adjustment of plate 200 to maintain suction gas intake communication with the rear suction chamber 162. Thus, the compressor provides the highest volumetric efficiency during its maximum capacity mode of FIGS. 2 and 11 whereby suction gas is fed by the front intake notch 210 and rear intake orifice 170, into both ends of the moving compartments between their outwardly moving vanes as they are rotated away from the throat area of the chamber 40.

As the rotor 50 is advanced, a portion of the suction gas consisting of the "suction volume" is trapped between two adjacent vanes and carried forward toward the "pinch-point" or throat area at the discharge ports 156. The term "suction volume" is defined as any portion of the moving compartments which, at any given position of the vanes 70*a*–70*d*, is in fluid communication with the suction enclosure 162 via the plate notch 210 and the rear orifice 170. As the moving compartments are advanced into the compression side of the working chamber the vanes will be forced inwardly. With the modulation plate 200 in its maximum capacity position (FIG. 2) the cut-off line 214 of its gas transfer notch 210 is positioned such that a maximum portion of the "suction volume" of the gas being compressed is captured and prevented from escaping so as to by-pass around the moving compartment trailing vane, such as vane 70*b* in the case of the volume between vanes 70*a* and 70*b*, for return to suction chamber 162. Upon the vane 70*a* reaching the discharge ports 156, the volume of gas in the moving compartment between vanes 70*a* and 70*b* is reduced resulting in a corresponding increase in pressure of the gas causing the discharge valve, consisting of the six valve reeds 154, to open and allow the gas to be discharged through ports 156. The compressed gas flows in the space 250 between the shell and the cylinder and passes through oil separated filter 174 for exiting through discharge outlet 252.

In the compressor's minimum capacity mode of operation, as viewed in FIG. 3, the modulator plate 200 is rotated in a counterclockwise direction by shaft 220 through an arc of about ninety degrees from its position in FIG. 2 to its position of FIG. 3. As a consequence, the plate notched-out cavity 210 is disposed so that the "suction volume" of a moving compartment, located between vanes 70*d* and 70*a* for example, is in communication with suction enclosure 162 as the vanes advance toward the discharge throat area. This occurs because the modulator plate cavity cut-off edge 214 is now located in the compression side of the working chamber 40 between, for example, the vanes 70*d*, 70*a* which are being forced inwardly. The result is that the front end cavity 210 allows a predetermined portion of the "suction volume" gas to by-pass the trailing vane 70*a* adjacent its forward side edge into the next successive moving compartment.

It will be appreciated that for any intermediate rotation of the modulator plate 200 the cut-off edge 214 of the cavity 210 is located so that a proportional quantity of the suction gas will be by-passed around a moving compartment trailing vane into the following moving compartment for return to the suction enclosure 162 via the crossover passage 240.

While the embodiment of the present invention as herein disclosed constitutes a preferred form, it is to be understood that other forms might be adopted.

I claim:

1. A rotary variable capacity refrigerant compressor comprising a shell-like housing closed at one end, a bored cylinder having front and rear heads fixed at each end to define a cylindrical working chamber, said cylinder telescoped within said housing such that said front cylinder head is in sealed relation with the open end of said housing, a rear rotor stub shaft fixed to and extending into said working chamber from said rear head on an axis eccentric to the axis of said chamber, a rotor tube journaled on said rear stub shaft for rotation about said eccentric axis within said chamber, said rotor tube having a plurality of slots therein, slidable vanes mounted in said slots engaging the wall of said working chamber separating said chamber into a plurality of moving compartments, discharge port means communicating with said working chamber adjacent its throat area, a front driven shaft coaxial with said rear stub shaft, said front driven shaft journaled in said front head with its inner end fixed to said rotor tube and its outer front end connected to drive means, a suction enclosure in said rear head communicating with suction inlet means in said housing closed-end, rear suction gas intake aperture means formed in said rear head communicating between said suction enclosure and the moving compartments on the expansion side of said working chamber, a circular recess formed in the inner face of said front head concentric with said cylinder working chamber, a capacity modulator plate rotatively mounted in said recess having a portion of its peripheral edge formed with an elongated arcuate notched-out cavity on its rearwardly facing surface, axially extending suction crossover passage means in said cylinder interconnecting said rear head aperture means and said front modulator plate cavity upon preselected maximum capacity orientation thereof, control means operative to rotate said modulator plate to said maximum capacity orientation, whereby the compressor moving compartments are fed suction gas from said rear head enclosure via both said rear head aperture means and said front modulator plate cavity on the expansion side of said working chamber, said control means operative for rotating said modulator plate from its maximum capacity orientation in the direction of rotation of said vanes such that said modulator plate cavity is advanced toward the working chamber throat area, whereby a predetermined portion of the gas in each moving compartment on the compression side of said working chamber is by-passed around the forward edge of the moving compartment trailing vane via said modulator plate cavity into the next successive working chamber resulting in said compressor operating at a reduced capacity.

* * * * *